US012085356B2

(12) United States Patent
Jones

(10) Patent No.: US 12,085,356 B2
(45) Date of Patent: Sep. 10, 2024

(54) ARCHERY RELEASE AND RELATED METHOD OF USE

(71) Applicant: H.I.T. Outdoors, LLC, Clay City, KY (US)

(72) Inventor: Brian K. Jones, Clay City, KY (US)

(73) Assignee: H.I.T. Outdoors, LLC, Clay City, KY (US)

( * ) Notice: Subject to any disclaimer, the term of this patent is extended or adjusted under 35 U.S.C. 154(b) by 0 days.

(21) Appl. No.: 18/149,822

(22) Filed: Jan. 4, 2023

(65) Prior Publication Data

US 2024/0219141 A1 Jul. 4, 2024

(51) Int. Cl.
*F41B 5/18* (2006.01)
*F41B 5/14* (2006.01)

(52) U.S. Cl.
CPC ..... *F41B 5/1469* (2013.01)

(58) Field of Classification Search
CPC ..... F41B 5/1469
See application file for complete search history.

(56) References Cited

U.S. PATENT DOCUMENTS

| | | | |
|---|---|---|---|
| 7,946,282 | B2 | 5/2011 | Jones |
| 8,146,578 | B2 | 4/2012 | Jones |
| 8,746,223 | B2 | 6/2014 | Jones |
| 9,915,491 | B2 | 3/2018 | Perry |
| 10,473,419 | B1 | 11/2019 | Jones |
| 10,473,420 | B1 | 11/2019 | Jones |
| 11,428,500 | B2 | 8/2022 | Langley |
| 2006/0042612 | A1 | 3/2006 | Stanislawski |
| 2013/0174820 | A1 | 7/2013 | Jones |

*Primary Examiner* — John A Ricci
(74) *Attorney, Agent, or Firm* — Warner Norcross + Judd LLP

(57) ABSTRACT

An archery release can include a release body, one or more calipers or jaws defining a bowstring notch, the jaws pivotally joined with a release body, and a trigger moveable between a hold mode to hold a bowstring and a release mode to release the bowstring. The release can include first and second magnets that exert a magnetic repelling force on one another, thereby causing the trigger to automatically reset to the hold mode, whereby the calipers or jaws reset to a closed position, optionally without the aid of any mechanical spring or other biasing element. The first and second magnets can be offset from one another to urge the trigger to move laterally relative to a longitudinal axis of the release, and thereby open the jaws or calipers. A related method of use is provided.

19 Claims, 4 Drawing Sheets

ARCHERY RELEASE AND RELATED METHOD OF USE

BACKGROUND OF THE INVENTION

The present invention relates to archery releases, and more particularly to a magnetic trigger system for use with such archery releases.

Archery releases are designed to temporarily hold a bowstring of an archery bow so that an archer can pull on the release and subsequently draw the bowstring to shoot an arrow from the bow. Archery releases typically assist an archer in quickly and cleanly releasing the bowstring, many times better than the archer can do using their fingers for this activity. Archery releases typically are designed to consistently release the bowstring when the archer shoots the arrow, and thus increase the accuracy of the shot.

Conventional archery releases include a head having one or more jaws that hold the bowstring, the jaws being urged open via a mechanical spring mechanism, a trigger mechanism that actuates the jaws, and a wrist strap or handle configured so that a user can hold the release. In use, an archer nocks an arrow on the bowstring and secures one or more jaws of the release around the bowstring or a loop associated with the bowstring. When the release is secured to the bowstring, the user can draw the bowstring by pulling the release which is attached to it. After the user fully draws the bowstring, aims the bow, and is prepared to shoot the arrow, the user actuates the trigger mechanism. This moves the one or more jaws and subsequently disengages the bowstring so that the bowstring can utilize its stored energy and propel the arrow from the bow.

After the trigger mechanism and jaws are actuated to release the bowstring, the user can prepare for a subsequent shot. The archer pushes the trigger forward manually, countering a force generated by the mechanical spring that urges the one or more jaws open. This mechanical spring force inherently prevents the trigger and jaws from returning to a closed configuration around the bowstring. To operate the release, the archer precisely pushes the trigger forward, and must be aware of when the trigger properly engages the jaws to close them around the bowstring for the subsequent shot preparation. An issue with this type of mechanism and resetting of the trigger/jaws is that it takes skill and awareness to properly operate the trigger and close the jaws to secure the bowstring therein. The trigger also needs to be manually reset by a forward motion on the trigger, which can be awkward in some orientations of the hand, and which can be thwarted when the archer is hurried for readying another arrow, for example, in a hunting or tournament scenario, for a quick follow-up shot on game or a target.

Accordingly, there remains room for improvement in the field of archery releases, for example, to facilitate movement of the jaws in an automatic or semi-automatic manner to facilitate opening and/or closing of the release during normal operation.

SUMMARY OF THE INVENTION

An archery release is provided and can include a release body, one or more calipers pivotally joined with a release body, and a trigger moveable between a hold mode to hold a bowstring and a release mode to release the bowstring. The release can include first and second magnets that produce a magnetic repelling force on one another, thereby causing the trigger to automatically reset to the hold mode, whereby the calipers reset to a closed position.

In one embodiment, the first and second magnets can be offset from one another to urge the trigger to move relative to a longitudinal axis of the release, and thereby open the calipers, also referred to as jaws herein.

In another embodiment, the magnetic repelling force can move the trigger laterally so that the trigger causes first and second jaws to move relative to one another and/or the body. The first and second jaws can move away from one another, motivated by this magnetic repelling force, to release a bowstring held by the first and second jaws, optionally without the aid of any mechanical spring or other biasing element.

In still another embodiment, the first and second magnets repel one another with reverse polarities, rather than attract one another, in all aspects of operation of the release.

In yet another embodiment, the first magnet can include a first face and a first axis projecting from the first face. The second magnet can include a second face and a second axis projecting from the second face. The first axis can be offset from the second axis by at least 0.050 inches. In some cases, the first center of the first magnet can be offset from a second center of the second magnet by an offset distance between 0.050 inches and 0.250 inches, inclusive.

In even another embodiment, the first magnet can repel the second magnet in a vertical direction and in a horizontal direction, optionally creating a multidirectional force vector. This multidirectional force vector can comprise a first magnetic force component that is aligned with, for example, parallel to a longitudinal axis of the release body. This first force component can urge the trigger to the hold mode, which in turn can close the one or more jaws around a bowstring or otherwise capture a bowstring in a bowstring notch.

In a further embodiment, the multidirectional force vector can comprise a second magnetic force component that can be transverse to the longitudinal axis of the release body. This transverse force component can urge the trigger and a bar or end thereof outward, away from the longitudinal axis, which in turn can translate to the one or more jaws moving away from one another to release a bowstring from the bowstring notch.

In still a further embodiment, the release can be a dual caliper release with first and second jaws rotatably joined with the release body. A roller can be rotatably joined with the second jaw opposite a second bowstring notch at a distal end of the second jaw. The trigger can include a bar and a sear. The first magnet can repel the second magnet so that the sear engages the roller to hold the second jaw in a closed position.

In yet a further embodiment, a method is provided. The method can include providing an archery release; transitioning a trigger from a hold mode to a release mode; wherein a magnetic repelling force optionally urges the trigger away from a longitudinal axis of the release body as the trigger transitions from the hold mode to the release mode, wherein the magnetic repelling force urges the trigger from the release mode to the hold mode after the release mode is achieved to automatically reset the archery release to the hold mode.

The current embodiments provide an archery release and method that can automatically operate the release via magnetic forces, optionally without the use of mechanical springs. Where included, magnets can be provided on different components to assist in moving a trigger bar and sear, transverse to a longitudinal axis of the release, to thereby open the one or more jaws relative to a bowstring. The magnets can also or alternatively automatically reset the trigger to a hold mode, and a user can optionally use this feature to capture a bowstring in one or more bowstring notches of the jaws.

These and other objects, advantages, and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DETAILED DESCRIPTION OF THE CURRENT EMBODIMENTS

Figure 1:
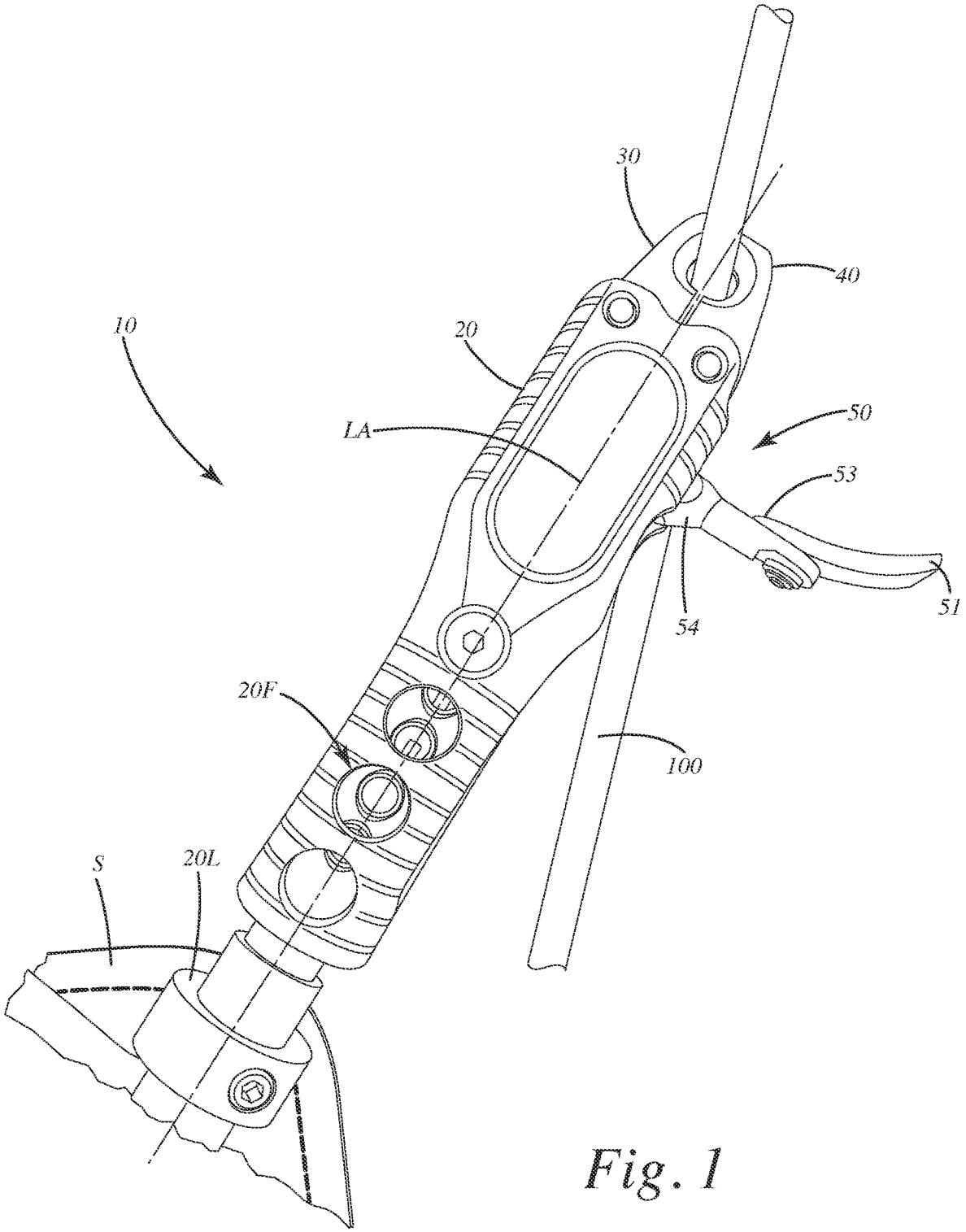
FIG. 1 is a perspective view of an archery release of a current embodiment.

A current embodiment of the archery release is shown in FIGS. 1-4 and generally designated 10. The archery release 10 can be joined with a strap 10S as shown, a handle, or any other grasping device which is not germane to the function of the release. The release 10 shown can include a release body 20 including a longitudinal axis LA, a first jaw 30, an opposing second jaw 40, and a trigger 50. The trigger 50 can include a distal end 51, a trigger finger engagement portion 53 and a bar 54 that extends to a proximal end 52 that is pivotally joined with the first jaw 30 via a trigger pin 55 having a pivot axis 55P about which the trigger 50 can rotate and/or move.

The release 10 as shown also includes a first magnet 60 joined with the release body 20, optionally disposed in a recess 23 defined by the release body, as well as a second magnet 70 joined with the trigger 50 or optionally one of the jaws. In general, the first 60 and second 70 magnets can be installed so that at all times in the release 10, their positive poles face one another, or their negative poles face each other, either of which produces a magnetic repelling force MRF. Thus, the magnets push away or repel from one another, via a reverse polarity orientation, rather than attract one another. The first 30 and second 40 jaws can be pivotally joined with the release body with pins 35 and 45 respectively, and further can interface with one another via a ball 44.

Figure 2:
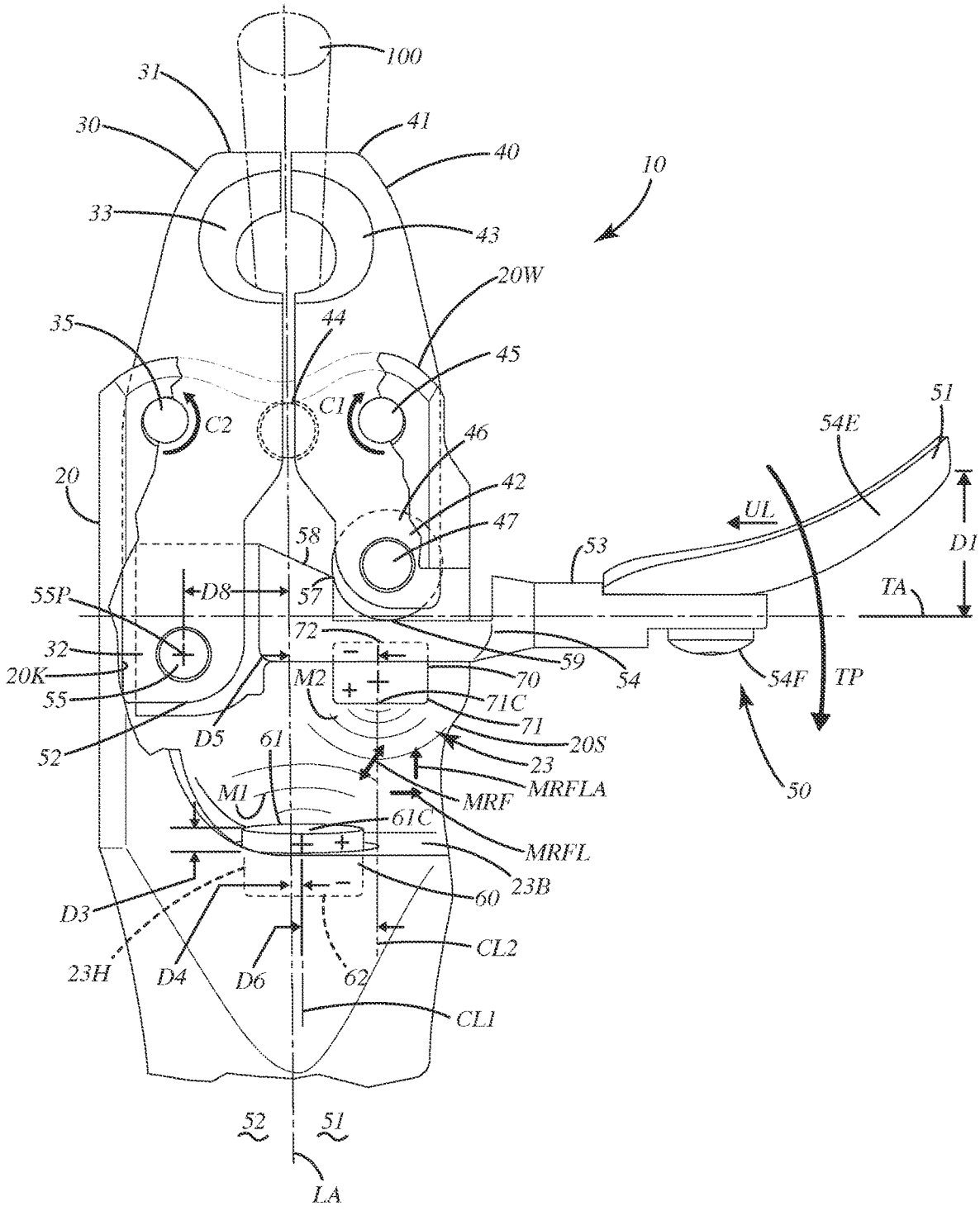
FIG. 2 is a section view of the archery release with a trigger thereof in a hold mode.
Figure 3:
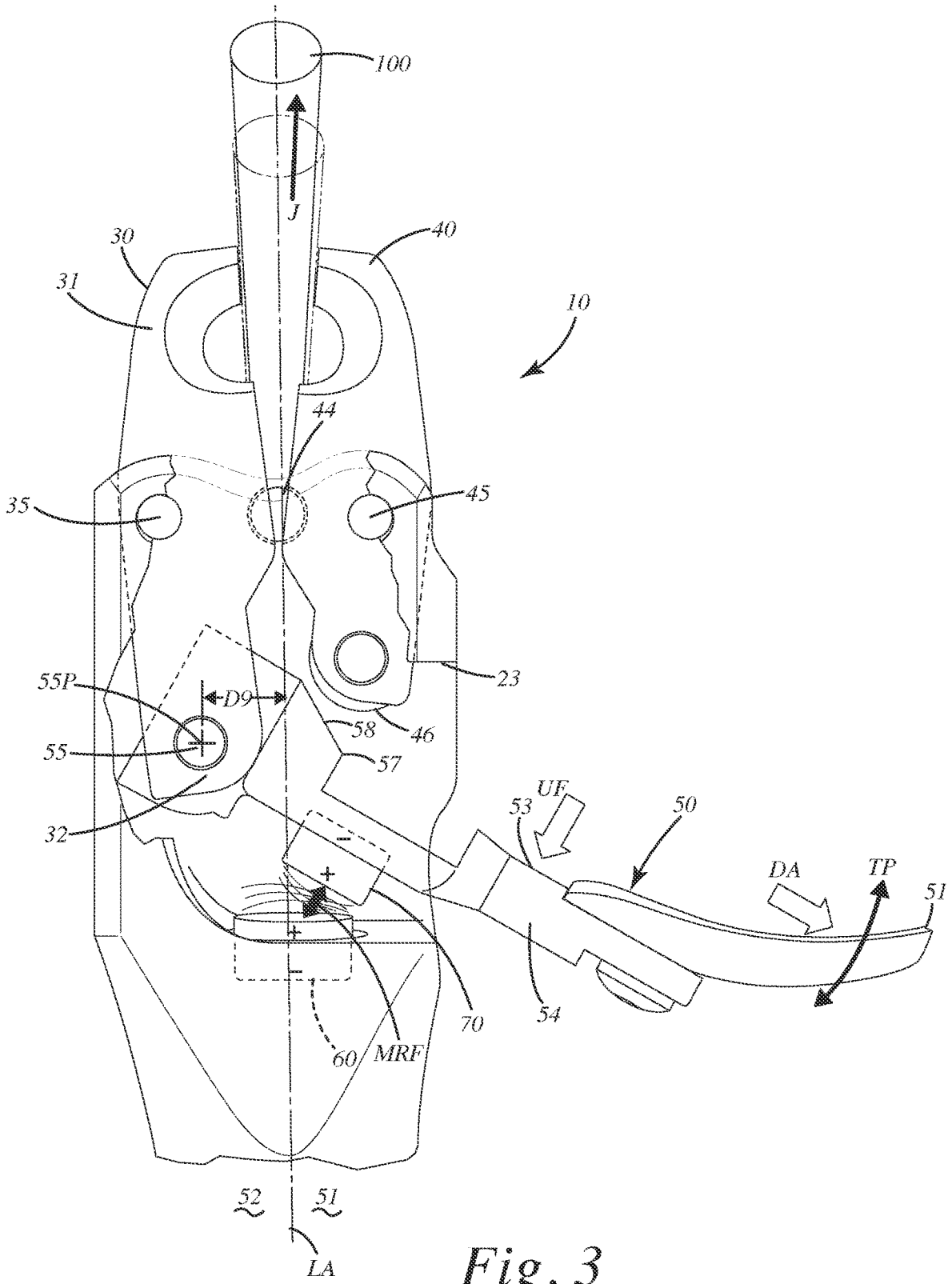
FIG. 3 is a section view of the archery release with the trigger in a release mode.
Figure 4:
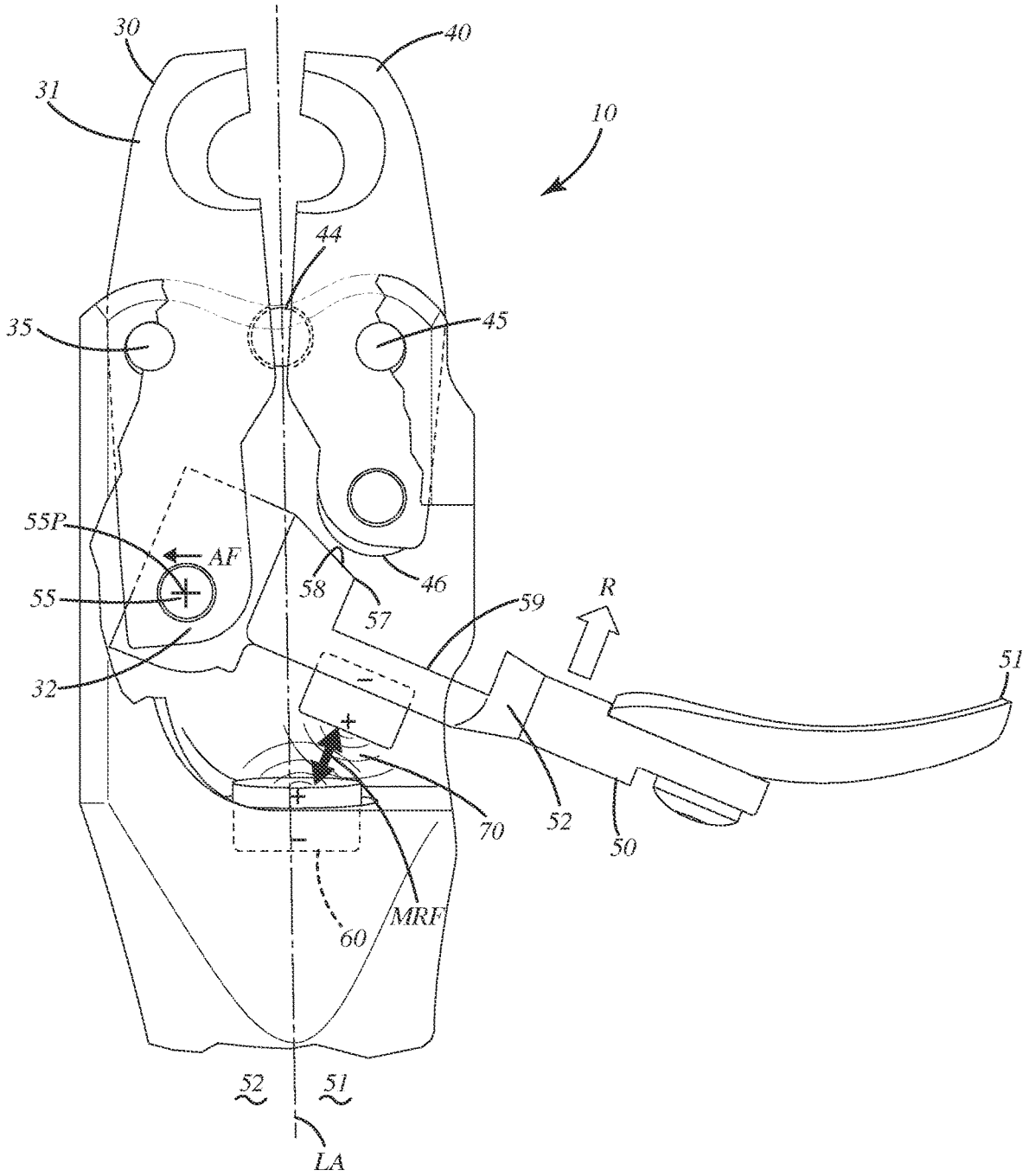
FIG. 4 is a section view of the archery release with the trigger automatically resetting to the hold mode, with the jaws resetting to respective closed positions.

After or as the trigger 50 is actuated from the hold mode in FIG. 2 to the release mode in FIG. 3, the first 60 and second 70 magnets are forced together via a manual user force UF input by a user, which produces or increases the magnetic repelling force MRF between the magnets and the components to which they are joined. The first and second magnets can be offset from one another and/or differently offset from the longitudinal axis LA as described below. By the magnets being offset in this manner, and facing one another with the same polarity (positive-positive, or negative-negative) the magnetic repelling force MRF shown in FIG. 4 pushes the trigger 50 back toward the hold mode of FIG. 2, which in turn moves the first 30 and second 40 jaws back toward and to their closed position. This of course is the opposite of what would occur if the magnets were oriented so that the forces attracted one another, with the magnets facing one another in a positive-negative orientation, which would cause the trigger to be held by such a magnetic force in the release mode, and the jaws to remain in the closed position due to the mutual attraction of the magnets. As shown in FIG. 4, the trigger is returned in direction R by the magnetic repelling force MRF toward the hold mode, shown in FIG. 2. The use of the magnets in the release also can eliminate the need for a mechanical spring between the jaws, and automatically resets the release without such a mechanical spring.

On a high level, the release 10 can be used to assist an archer in drawing and releasing the bowstring 100. When the release is in a closed position, as shown in FIGS. 1 and 2, and used to draw the bowstring 100, the trigger 50 can be in the hold mode as illustrated. The trigger 50 can prevent the jaws 30, 40 from moving, thereby keeping the bowstring 100 captured in the bowstring notches 33, 43. The release 10 and its jaws can be actuated from a closed position shown in FIGS. 1 and 2, to an open position, shown in FIG. 3, by a user engaging and actuating the trigger engagement portion 53 with a manual force UF sufficient to rotate the trigger 50 about the trigger pivot pin 55. After the manual force UF engages the trigger 50 sufficiently, the trigger moves along a travel path TP, which can be a dynamic, curvilinear path about the trigger pivot pin 55 and its axis 55A, while the magnetic repelling force MRF also moves the trigger 50 and its components transversely across or relative to, or laterally away from, the longitudinal axis LA, spreading the distal ends 31, 41 of the jaws 30, 40 to transition the jaws to the open position. The path optionally can be any other curvilinear path, linear path, or combinations thereof as desired.

As used herein, "bowstring" refers to an actual bowstring of an archery bow and any device or component adapted to join with a bowstring of an archery bow and aid an archer in drawing or releasing the bowstring, including rope loops, which are attached to the bowstring above and/or below the location where an arrow nock rests, and receives, for example, a metal loop or partial loop that is joined with the bowstring above and below, or only above, or only below the location where the arrow nock rests on the bowstring.

As used herein "archery bow" refers to any compound bow, recurve bow, long bow, crossbow or any other device that propels or is capable of propelling an arrow, bolt or similar projectile.

Further, although the release illustrated and described herein generally is a dual caliper wrist strap release, the construction can be modified for any other type of archery release including, but not limited to, single caliper fixed jaw releases, rope releases, back tension releases, thumb releases, plunger releases, pinky releases, releases with or without wrist straps, hunting releases, target releases, and the like.

Turning now to FIGS. 1-4, the various components of the release will now be described in further detail. As mentioned above, the release can include a release body 20, a trigger 50 and magnets 60, 70. The release body 20 can be an elongated element having an adjuster element 20F and a connection end 20C that connects to a strap S which may encircle a portion of a user's wrist during use of the release. The release body 20 can include a longitudinal axis LA which can bisect its structure into opposing right and left sides, or a first side S1 and a second side S2, and/or top and bottom portions. The release body 20 can define a recess 23 that is sufficiently sized to house all or a portion of the jaws 30, 40 and parts of the trigger 50. The release body 20 also can define apertures to receive jaw pins 35 and 45 which join pivotally the respective jaws 30 and 40 to the release body. These pins 35 and 45 can project through corresponding apertures or holes defined in the respective jaws 30 and 40.

The jaws 30 and 40 are shown in the form of a dual caliper construction with the jaws opposite one another about a longitudinal axis LA. This construction enables the jaws to move away from one another, optionally away from the longitudinal axis LA or more generally to enable at least one jot to move and subsequently release the bowstring 100 from one or more of the bowstring notches 33 and 43. Generally the bowstring notches 33 and 43 can include one or more curvilinear, planar or other smooth surfaces that are configured to hold yet minimize wear and tear on the bowstring 100. The bowstring notches can be disposed along or can face longitudinal axis LA of the release body 20. Each notch as shown can be of a U or V shape opening or recess defined by the distal ends of the movable jaws 30 and 40. These notches can be configured to mate with, capture and/or otherwise interface with the bowstring 100.

As shown in FIGS. 2 and 3, the jaws 30 and 40 have mounted therebetween a ball 44, which facilitates rotation of the jaws relative to one another and/or the respective pins 35 and 45 from a closed position shown in FIG. 2 to an open position shown in FIG. 3. The jaws 30 and 40 also can be constructed and operated in this in the release 20 such that there is no mechanical spring, such as a coil spring, leaf spring, or other elastomeric element disposed between any portion of the jaws, to facilitate rotation relative to one another or about the respective jaw pins 35 and 45. Again, the movement of the jaws 30, 40 from a closed position to an open position and vice versa is motivated substantially entirely and/or only by the magnetic repelling forces MRF produced by the magnets 60 and 70 as described below. The release can be void of any mechanical spring or other biasing element between the jaws and the release body and/or other components.

As shown in FIG. 2, the first jaw 30 again can include a distal end 31 and a proximal end 32. The proximal end 32 can define an aperture to receive the trigger pin 55 which connects the first jaw movably, pivotally or rotatably to the trigger 50. The second jaw 40 can include a distal end 41 and a proximal end 42. The proximal end 42 can include a roller or disk 46 that is rotatably joined to the proximal end 42 of the jaw 40 via a roller pin 47. The roller 46 can be free to rotate relative to the pin and/or jaw 40. This roller can be configured to interface with a sear 57 of the trigger 70 as described below. Each of the respective first jaw and second jaw, and in particular, the proximal ends 32 and 42 and parts thereof, can be movably disposed in the recess 23 defined by the release body 20. The distal ends 31, 41, bowstring notches, etc. of the first and second jaws 30 and 40 can generally protrude outward from the forward part 20W of the release body 20.

As further shown in FIGS. 2-3, the release body 20 can at least partially house the trigger 50, which extends laterally from the body 20, for example, from a side 20S of the release body 20, and can be accessed by an archer with one or more of the archer's digits, for example, an index finger or some other finger depending on the configuration of the release. The trigger 50 can be joined with at least one of the first jaw 30 and the release body 20 and generally movable along a travel path TP, between a hold mode, shown in FIG. 2 to a release mode shown in FIG. 3. The trigger 50 can be movably disposed at least partially within the recess 23. The trigger 50 can include a distal tip or end 51, a trigger engagement portion or surface 53, a bar 54 that extends to the jaw 30 and is connected thereto via a trigger pin 55. Accordingly, the bar 57 can be rotatable about the trigger pin 55 and its pivot axis 55P.

The trigger bar 50 can further be associated with a trigger sear 57, which as mentioned above selectively engages, contacts, slides and/or rolls relative to the roller 46 which is associated with the second jaw 40. A sear ramp 58 can be disposed adjacent the sear 57. When actuated from the hold mode to the release mode, the roller 46 can be released past the sear 57 and can roll, slide or otherwise move along the sear ramp 58 generally in the relative direction K along that ramp 58. In so doing, the jaw 40 attached to the roller 46 rotates in direction C1 about the pivot pin 45 thereby moving the bowstring notch 43 and the distal end 41 of the jaw 40 away from the bowstring 100, the longitudinal axis LA and/or the first jaw 30. Likewise, as described below, when the trigger is converted from a hold mode to a release mode, the first jaw 30 rotates in direction C2 about the pivot pin 35 thereby moving the bowstring notch 33 and the distal end 31 of the jaw 30 away from the bowstring 100, the longitudinal axis LA and/or the second jaw 40.

As mentioned above, and as shown in FIG. 2, the trigger 50 can include a trigger bar 54. This trigger bar 54 optionally can include an extender 54E which extends to the distal end 51 of the trigger 50. The extender 54E can be secured to an end of the bar via fastener 54F. The extender 54E can curve or angle forward from the axis TA in the hold position shown in FIG. 2 such that the distal end 51 is a distance D1 forward from the axis TA of the bar. This can assist in guiding a user's digits toward an into engagement with the finger engagement portion 53 of the trigger 50 so that the user generally does not exert a user lateral force UL on the trigger bar, urging the trigger 50 generally toward the longitudinal axis LA. This user lateral force UL in some cases might bind the trigger bar and trigger in general against the first jaw 30, thereby preventing the first and second jaws from transitioning to the closed position shown in FIG. 2 to the open position shown in FIG. 3.

As further shown in FIG. 2, the trigger 50 as mentioned above can include the trigger bar 54 that extends into the recess 23 and is joined with the first jaw 30 via a trigger pin 55. The trigger bar can include the sear 57 and the sear ramp 57 that is adjacent the sear 57. The sear bar can further define a roller recess 59 within which the roller 46 can be selectively disposed when the trigger is in the hold mode. The roller recess 59 can be disposed between the sear 57 and the trigger engagement portion 53.

As mentioned above, the release 10 can include one or more magnets that cooperate with one another to exert a magnetic repelling force MRF which performs a variety of functions. As shown in FIG. 2, the release 10 can include a first magnet 60 that is joined with the release body 20. This first magnet 60 can be disposed and/or associated with a back wall 23B of the recess 23. The first magnet 60 optionally can be in the form of a cylindrical-type magnet that is disposed in an aperture, recess or hole 23H defined by the back wall 23B of the recess 23 defined by the release body 20. The first magnet can have a diameter of 3/16 inch and can be ¼ inch in length, but of course can be of other dimensions. The first magnet (as well as the second magnet) can be a neodymium magnet, a ferromagnetic magnet, a samarium magnet, an Alnico magnet, or other types of magnets. The first magnet 60 can protrude a preselected distance D3 from the back wall 23B of the release body 20 adjacent the recess 23. Of course, the first magnet may be flush with the back wall 23B, or can extend different distances away from the back wall 23B, depending on the application. The magnet 60 can be oriented as shown in FIG. 2 with its positive pole "+" oriented and facing into the recess 23 and generally toward the trigger 50. The negative pole "−" can face away from the back wall 23P and away from the trigger 50.

The first magnet 60 optionally can include a first face 61 that can face toward the trigger 50, away from the adjuster element 20F of the release 20. The first face can be in the form of a circular first face when the magnet is of a cylindrical, circular or disk like construction. Of course it can have other shapes depending on the construction. The first magnet also can include a second face 62 that is disposed at the opposite end of the magnet 60. This second face can be identical in shape, and optionally circular, to the first face. The first magnet can include a centerline CL1 that can be disposed and oriented coincident with the centers of the first and second faces 61, 62 of the magnet. Where the centerline CL1 projects from the respective first face and second face of the first magnet 60, the magnet can include a center of that face. For example, the centerline CL1 can correspond to a first center 61C of the first face 61 of the first magnet 60.

As can be seen in FIG. 2, the first magnet 60 can be a stationary magnet, fixed in place in the back wall 23B or generally fixed relative to the remainder of the release body, in an immovable configuration. Further, this first magnet 60 optionally can be located and positioned within the recess 23 and relative to the release body 20 in one or more suitable locations. As shown, the first magnet 60 can be positioned so that its centerline CL1 can be parallel to the longitudinal axis LA. The centerline CL1 however can be offset relative to the longitudinal axis, closer to the lateral side surface 20S of the release body 20 than the longitudinal axis LA. The centerline CL1 and the respective first center 61C can be disposed a distance D4 from the longitudinal axis LA. This distance D4 optionally can be 0 inches, at least 0.100 inches, at least 0.200 inches, at least 0.300 inches, at least 0.400 inches, at least 0.500 inches, between 0.050 inches and 0.500 inches, inclusive, or other distances depending on the application and the desired magnetic repelling force MRF. In some applications and configurations, the longitudinal axis LA can intersect the first face 61 and/or the magnet 60 in general. Optionally, the longitudinal axis can be orthogonal to the first face 61. In other cases, the longitudinal axis LA can be offset from the first face and not intersect it or the magnet.

The first magnet 60 can be positioned so that the first face and/or a magnetic pole faces toward the respective bowstring notches 43 and/or 33 of the respective jaws 40 and 30. In some cases, the first magnet 60 can be disposed on the same side S1 of the longitudinal axis LA as the second bowstring notch 43, but optionally not on the same side of the longitudinal axis as the first bowstring notch 33. Further optionally, the first magnet 60 can be disposed rearward from the second jaw 40, and on the same side S1 of the longitudinal axis LA as the roller 46 and/or second jaw 44. As shown in FIG. 2, the first magnet 60 and its first face 60 can be disposed between the roller pin 47 and the trigger pin 55, when the first jaw 30 and the second jaw 40 are in the closed position, when the relative positions of these elements are taken along a reference line that is perpendicular to the longitudinal axis LA.

With further reference to FIG. 2, the first magnet 60 can exert a magnetic field M1 projecting generally from and around the first face 61. This magnetic field can project upwardly into the recess 23 toward the trigger and/or the respective jaws 40 and 30. This magnetic field M1, when encountering a similar magnetic field M2 from the second magnet 70 as described above, can produce the magnetic repelling force MRF between the respective first magnet 60 and second magnet 70, which in turn can provide the functionality described below.

Turning now to the second magnet 70 as shown in FIG. 2, this magnet can be joined with a trigger 50. Because it is joined with the trigger 50, this second magnet can be movable with the trigger, for example movable with the trigger bar 54. The magnet 70 also can be configured to move along an arcuate and/or curvilinear path about a pivot axis 55P of the trigger pin 55. This magnet optionally is not stationary relative to the release body, and instead moves relative to the release body and of course the first magnet 60, toward and away from that magnet. The second magnet 70 can include a second face 71 the faces away from the trigger 50 and toward the back wall 23B of the release body 20, generally toward the first magnet 60. The second face 71 optionally can be in the form of a circular second face when the magnet is of a cylindrical, circular or disk-like construction, similar to the first face of the first magnet. The second magnet also can have a distal face 72 that is disposed at the opposite end of the magnet 70. This face can be identical in shape and optionally circular, similar to the second face 71. The second magnet 70 can include a centerline CL2 that is disposed and oriented coincident with the center of the second face 71 and the other face 72 of the magnet 70. Where the centerline CL2 projects from the respective faces, of the second magnet 70, the magnet 70 can include a center of that respective face. For example, centerline CL2 can correspond to a second center 71C of the second face 72 of the second magnet 70.

The second magnet 70 can be disposed under the recess 59 in the trigger bar 54 that accommodates the roller 46. The second magnet 70 can be disposed between the trigger pin 55 and the trigger engagement portion 53 of the trigger 50. As shown, the second magnet 70 can be positioned so that its centerline CL2 can be generally parallel to and/or aligned relative to the longitudinal axis LA and optionally parallel to, or aligned at some small angle, optionally 1 degrees to 10 degree relative to, the centerline CL1 of the first magnet 60. The centerline CL2, however, can be offset relative to the longitudinal axis LA, closer to the lateral side surface 20S of the release body 20 than the longitudinal axis LA. The centerline CL2 and the respective first center 71C can be disposed a distance D5 from the longitudinal axis LA. This distance D5 can be greater than the distance D4 as described above. This distance D5 optionally can be at least 0.250 inches, at least 0.300 inches, at least 0.400 inches, at least 0.500 inches or other distances depending on the application and the desired magnetic repelling force MRF. Further optionally, the longitudinal axis can be laterally offset from the second face 71 and/or the magnet 70, such that the longitudinal axis does not intersect those components.

The second magnet 70 can include opposing positive and negative poles. The second magnet can be positioned so that the second face and/or pole faces toward the back wall 23S and/or generally toward the first magnet 60. The pole can be a positive pole "+" and can face toward the corresponding positive pole of the first magnet 60. The second magnet 70 can exert a magnetic field M2 projecting from and around the second face 71. Again, when encountering the similar magnetic field M1 of the first magnet 60, this can produce the magnetic repelling force MRF. As further illustrated in FIG. 2, the second magnet 70 can lay on a common side S1 of the longitudinal axis LA with the first magnet 60. The second magnet 70 can be disposed on an opposite side of the bar 54 of the trigger 50 from the roller 46.

As mentioned above, the first and second magnets can be positioned relative to one another to generate the magnetic repelling force MRF which can be used to operate the release 10. As an example, the first centerline CL1 and the first center 61C of the first magnet 60 can be laterally offset from the second centerline CL2 and the second center 71C of the second magnet 70 a distance D6. This distance D6 can be optionally at least 0.050 inches, at least 0.100 inches, between 0.050 inches in 0.250 inches, inclusive, between 0.1 to 3 inches and 0.183 inches, inclusive, between 0.100 inches and 0.200 inches, inclusive, or other distances depending on the applicable magnetic repelling force MRF to be generated between the magnets and achieve a suitable functionality to provide movement of the trigger and jaws, and to automatically reset the trigger to the hold mode shown in FIG. 2 and the jaws to the closed positions in FIG. 2.

In general, the method of automatically resetting the trigger can include providing the archery release 10 including one or more of the jaws 30, 40, and the trigger 50 and transitioning the trigger from a hold mode to a release mode. The magnetic repulsion force MRF can urge the trigger 50 from the release mode to the hold mode after the release mode is achieved to automatically reset the archery release to the hold mode. The magnetic repulsion force MRF also can urge the trigger 40 away from a longitudinal axis or a recess or side surface of the release body as the trigger transitions from the hold mode to the release mode, so as to move the jaws 30 and 40 from a closed position to an open position.

To perform this method of automatic resetting of the release, the first 60 and second 70 magnets can be oriented relative to one another so that the magnets exert the respective magnetic fields M1 and M2. As a result of these magnetic fields encountering, overlapping and/or crossing one another, the magnetic repelling force MRF is exerted by each magnet on the other. This in turn causes the trigger to automatically reset from the release mode shown in FIG. 3, where the jaws 30 and 40 are in the open position to release the bowstring in direction J, to the closed position shown in FIG. 2. The trigger can automatically reset to the hold mode, optionally after the trigger is depressed and then released by the user. The transition from the release mode shown in FIG. 3 to the hold mode shown in FIG. 2 is generally illustrated in FIG. 4. There, the trigger 50 moves in direction R back toward its release mode configuration. The jaws 30 and 40 move in the respective directions C3 and C4 about the respective pins 35 and 45 as this occurs. The sear 57 also engages the roller 46 and moves along it until the roller is disposed in the recess 59 of the sear bar 54. Again, all of this movement can be due to the magnetic repelling force MRF between the first magnet 60 and the second magnet 70, which repel one another due to the orientations of the respective, same poles of those magnets.

As shown in FIG. 2, the magnets 60 and 70 can be initially positioned relative to one another so that the respective magnetic fields M1 and M2 overlap and produce a magnetic repelling force MRF. This magnetic repelling force can have a first magnetic force component MRFLA, which can be generally parallel to the longitudinal axis LA. The magnetic repelling force MRF can also include another second magnetic force component MRFL that is transverse to the longitudinal axis LA, generally extending outward laterally relative to the longitudinal axis LA. This second magnetic force component MRFL optionally can change dynamically in direction as the trigger rotates or moves about the trigger pin 55.

With the different magnetic force components MRFLA and MRFL, the first magnet 60 urges the second magnet 70 in one or more directions. For example, the first magnetic force component MRFLA can urge the trigger 50 away from the first magnet, toward the hold mode of the trigger shown in FIG. 2. The second magnetic force component MRFL can urge the trigger and its distal end 51 generally away from the longitudinal axis LA in a direction DA as shown in FIG. 3. This transverse direction or movement of the trigger can occur as the user exerts a user force UF to move the trigger 50 so that the second magnet 70 moves toward the first magnet 60 shown there. In effect, the trigger and its portions, for example, the distal trigger end 51 can move in direction DA generally away from the longitudinal axis. As a result of this magnetic repelling force MRF and the transverse component thereof MRFL, the trigger bar 54 transitions and moves laterally and transversely relative to the longitudinal axis in the direction DA generally as the trigger moves along the travel path TP. Optionally, it is to be noted that when one magnet or force urges a component or magnet in a direction or to an orientation, that component or magnet may or may not move in that direction or to that orientation. In some cases, the urging may be great enough to actually move the component or magnet, while in others, the urging may be overcome by another force that prevents or impairs the movement.

As a result of this transverse or lateral movement away from or relative to the longitudinal axis LA, or generally away from the opposing recess sidewall 20K, which bounds the recess 23 with the back wall 23B, the pivot trigger pin 55 associated with the jaw 30 can move toward the longitudinal axis and away from the recess sidewall 20K as the trigger 50 transitions from the hold mode shown in FIG. 2 to the release mode shown in FIG. 3. This is better illustrated with reference to the pivot axis 55P of the trigger pin 55. For example, as shown in FIG. 2, the pivot axis 55P begins in the hold mode at a distance D8 from the longitudinal axis LA. As the user exerts a force UF on the trigger engagement surface 53, the trigger 50 begins to move along the travel path TP. As this occurs, the magnetic force MRF, and in particular the force component MRFL transverse to the longitudinal axis urges the bar 54 and the distal tip 51 away from the lateral side surface 20S of the release body, or generally away from the recess 23 and outward from the release body 20. As this occurs, the proximal end 32 of the first jaw 30 moves toward longitudinal axis LA and the distal end 31 moves away from longitudinal axis LA, due to the entire jaw rotating in direction C2 about the pin 35. The trigger bar 54, which has the second magnet 70 attached to it, is urged outwardly from the recess and somewhat away from the longitudinal axis LA. Due to the trigger bar being connected via the trigger pin 55 to the jaw 30, the jaw moves as noted above. As a result, the pivot axis 55P of the trigger pin 55 moves toward or closer to the longitudinal axis LA. When this occurs, the distance D8 in the hold mode shown in FIG. 2 decreases to the lesser distance D9 shown in FIG. 3 in the release mode. Again, this also assists movement of the trigger bar, the associated sear 57 relative to the roller 44, to assist in opening both jaws 30 and 40 to an open position shown in FIG. 3.

Optionally, as the trigger is actuated and moved along the travel path TP by the user force UF, the magnetic repelling force can increase in magnitude or strength, due to the magnets 60 and 70 becoming closer to one another. As a result, the user may increase the user force UF to continue moving the trigger along the travel path to get the trigger to the release mode. The user force to move the trigger and rotate the trigger about the pivot axis 55P can be greatest as the trigger approaches the full release mode shown in FIG. 3.

When the jaws 30 and 40 open to the open position shown there in FIG. 3, the bowstring 100 can be released and move in direction T. After the bowstring 100 is released from the release 10, the user can remove the manual force UF from the trigger 50. When this occurs, the first and second magnets automatically reset the trigger from the release mode shown in FIG. 3 back to the hold mode shown in FIG. 2. As this occurs, the trigger 50 transitions between those modes as shown in FIG. 4. As shown there, the trigger 50 is resetting to the hold mode in direction R, rotating about the trigger pin 55 and in particular the pivot axis 55P. The trigger 54 is also moving such that the sear ramp 58 and sear 57 engage the roller 44 of the second jaw 40, riding or sliding along the same, until the sear moves far enough to eventually hold the second jaw 40 in its closed position when the trigger 50 achieves the hold mode.

The magnetic repelling force MRF can be responsible for the movement of the trigger 50 due to the magnetic repelling force components as described above. The trigger continues to move in direction R and the respective jaws 30 and 40 move toward longitudinal axis LA to a closed position. These jaws rotate about the respective pins 35 and 45 in directions C3 and C4 respectively as described above. Again, all of this movement can be achieved via the magnetic repelling force MRF generated by the repulsion of the first and second magnets. No additional mechanical spring or other biasing element number might be used in this resetting operation.

It will be appreciated that as the trigger moves in direction R, the magnets continue to repel one another via the magnetic repelling force MRF. The magnetic repelling force, however, can decrease in strength as the trigger moves farther from the release mode to the hold mode shown in FIG. 2. This can be due to the magnetic fields M1 and M2 overlapping one another less and less as the trigger moves in direction R. The magnetic repelling force MRF as mentioned above can include the transverse magnetic repelling force MRFL that urges the second magnet and the trigger 50 outward from the longitudinal axis. Although being urged in this direction, the mechanical interaction of the roller 44 on the sear ramp 58 and sear 57 mechanically urge the trigger pin 55 and trigger pin axis 55P away from the longitudinal axis LA on the second side S2 in direction AF, shown in FIG. 4. In turn, this causes the second or proximal end 32 of the jaw to move away from the longitudinal axis LA, while the first or distal end 31 of the jaw moves toward the jaw to move the jaw 30 to the closed position. The magnetic repelling force MRF also exerts the other force component MRFLA in a direction somewhat parallel to the longitudinal axis so that the trigger moves away from the back wall 23B of the recess 23, and generally toward the second jaw 40. With this movement, the trigger can automatically reset via the magnetic repelling force 50, and the respective jaws 30 and 40 can be closed to a hold mode again, optionally around a bowstring 100 if one is placed within the bowstring notches 33 and 43. The magnetic repelling force also maintains and secures the trigger and jaws in this hold mode after the foregoing automatic reset occurs.

Although the different elements and assemblies of the embodiments are described herein as having certain functional characteristics, each element and/or its relation to other elements can be depicted or oriented in a variety of different aesthetic configurations, which support the ornamental and aesthetic aspects of the same. Simply because an apparatus, element or assembly of one or more of elements is described herein as having a function does not mean its orientation, layout or configuration is not purely aesthetic and ornamental in nature.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation(s).

In addition, when a component, part or layer is referred to as being "joined with," "on," "engaged with," "adhered to," "secured to," or "coupled to" another component, part or layer, it may be directly joined with, on, engaged with, adhered to, secured to, or coupled to the other component, part or layer, or any number of intervening components, parts or layers may be present. In contrast, when an element is referred to as being "directly joined with," "directly on," "directly engaged with," "directly adhered to," "directly secured to," or "directly coupled to" another element or layer, there may be no intervening elements or layers present. Other words used to describe the relationship between components, layers and parts should be interpreted in a like manner, such as "adjacent" versus "directly adjacent" and similar words. As used herein, the term "and/or" includes any and all combinations of one or more of the associated listed items.

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, any combination of X, Y and Z, for example, X, Y, Z; X, Y; X, Z; Y, Z, and/or any other possible combination together or alone of those elements, noting that the same is open ended and can include other elements.

What is claimed is:

1. An archery release comprising:

a release body having a longitudinal axis, the release body defining a recess;

a first magnet joined with the release body and stationary relative thereto;

a first jaw joined with the release body, the first jaw moveable between a closed position and an open position, the first jaw defining a bowstring notch, the first jaw moveably disposed in the recess defined by the release body;

a trigger joined with at least one of the first jaw and the release body, the trigger moveable along a travel path, between a hold mode and a release mode, the trigger movably disposed in the recess defined by the release body; and a second magnet joined and moveable with the trigger, wherein the second magnet and the first magnet are configured to exert a magnetic repelling force on one another, thereby urging the trigger to automatically reset to the hold mode after the trigger is depressed and released by a user, whereby the first jaw resets to the closed position, wherein the first magnet includes a first face and a first axis projecting from the first face, wherein the second magnet includes a second face and a second axis projecting from the second face, wherein the first axis is offset from the second axis by at least 0.050 inches.

2. An archery release comprising:

a release body having a longitudinal axis, the release body defining a recess;

a first magnet joined with the release body and stationary relative thereto;

a first jaw joined with the release body, the first jaw moveable between a closed position and an open position, the first jaw defining a bowstring notch, the first jaw moveably disposed in the recess defined by the release body;

a trigger joined with at least one of the first jaw and the release body, the trigger moveable along a travel path, between a hold mode and a release mode, the trigger movably disposed in the recess defined by the release body; and a second magnet joined and moveable with the trigger, wherein the second magnet and the first magnet are configured to exert a magnetic repelling force on one another, thereby urging the trigger to automatically reset to the hold mode after the trigger is depressed and released by a user, whereby the first jaw resets to the closed position, wherein a first center of the first magnet is offset from a second center of the second magnet by an offset distance between 0.050 inches and 0.250 inches, inclusive, whereby the first magnet repels the second magnet in a first direction and simultaneously in a second direction transverse to the first direction so that a proximal end of the first jaw moves toward the longitudinal axis, as the trigger is depressed by the user.

3. The archery release of claim 2, wherein the offset distance is between 0.123 inches and 0.183 inches, inclusive.

4. An archery release comprising:

a release body having a longitudinal axis, the release body defining a recess;

a first magnet joined with the release body and stationary relative thereto;

a first jaw joined with the release body, the first jaw moveable between a closed position and an open position, the first jaw defining a bowstring notch, the first jaw moveably disposed in the recess defined by the release body;

a trigger joined with at least one of the first jaw and the release body, the trigger moveable along a travel path, between a hold mode and a release mode, the trigger movably disposed in the recess defined by the release body;

a second magnet joined and moveable with the trigger; and a second jaw joined with the release body, on an opposite side of the longitudinal axis of the release body, the second jaw moveable between a closed position and an open position, the second jaw defining another bowstring notch that cooperates with the bowstring notch of the first jaw to capture a bowstring therein, the second jaw moveably disposed in the recess defined by the release body, wherein the second magnet and the first magnet are configured to exert a magnetic repelling force on one another, thereby urging the trigger to automatically reset to the hold mode after the trigger is depressed and released by a user, whereby the first jaw resets to the closed position.

5. The archery release of claim 4 comprising:

a second jaw rotatably joined with the release body; and a roller rotatably joined with the second jaw opposite the other bowstring notch, wherein the trigger includes a bar and a sear, wherein the first magnet repels the second magnet and the bar with the magnetic repelling force so that the sear engages the roller to hold the second jaw in the closed position.

6. An archery release comprising:

a release body having a longitudinal axis, the release body defining a recess;

a first magnet joined with the release body and stationary relative thereto;

a first jaw joined with the release body, the first jaw moveable between a closed position and an open position, the first jaw defining a bowstring notch, the first jaw moveably disposed in the recess defined by the release body;

a trigger joined with at least one of the first jaw and the release body, the trigger moveable along a travel path, between a hold mode and a release mode, the trigger movably disposed in the recess defined by the release body; and a second magnet joined and moveable with the trigger, wherein the second magnet and the first magnet are configured to exert a magnetic repelling force on one another, thereby urging the trigger to automatically reset to the hold mode after the trigger is depressed and released by a user, whereby the first jaw resets to the closed position, wherein the first magnet includes a first face facing into the recess defined by the release body, wherein the longitudinal axis intersects the first face.

7. An archery release comprising:

a release body having a longitudinal axis, the release body defining a recess;

a first magnet joined with the release body and stationary relative thereto;

a first jaw joined with the release body, the first jaw moveable between a closed position and an open position, the first jaw defining a bowstring notch, the first jaw moveably disposed in the recess defined by the release body;

a trigger joined with at least one of the first jaw and the release body, the trigger moveable along a travel path, between a hold mode and a release mode, the trigger movably disposed in the recess defined by the release body; and a second magnet joined and moveable with the trigger, wherein the second magnet and the first magnet are configured to exert a magnetic repelling force on one another, thereby urging the trigger to automatically reset to the hold mode after the trigger is depressed and released by a user, whereby the first jaw resets to the closed position, wherein the first magnet includes a circular first face having a first center, wherein the second magnet has a circular second face having a second center, wherein the first center is laterally offset from the second center by at least 0.050 inches so that the magnetic repelling force urges the second center to move relative to the longitudinal axis and the trigger to move transversely relative to the longitudinal axis when the trigger transitions to the release mode.

8. An archery release comprising:

a release body having a longitudinal axis, the release body defining a recess;

a first magnet joined with the release body and stationary relative thereto;

a first jaw joined with the release body, the first jaw moveable between a closed position and an open position, the first jaw defining a bowstring notch, the first jaw moveably disposed in the recess defined by the release body;

a trigger joined with at least one of the first jaw and the release body, the trigger moveable along a travel path, between a hold mode and a release mode, the trigger movably disposed in the recess defined by the release body; and a second magnet joined and moveable with the trigger, wherein the second magnet and the first magnet are configured to exert a magnetic repelling force on one another, thereby urging the trigger to automatically reset to the hold mode after the trigger is depressed and released by a user, whereby the first jaw resets to the closed position, wherein the trigger includes a trigger end, wherein the magnetic repelling force urges the trigger end laterally away from the release body and the recess as the trigger transitions to the release mode, whereby a proximal end of the first jaw moves toward the longitudinal axis.

9. An archery release comprising:

a release body having a longitudinal axis;

a first magnet joined with the release body;

a first jaw joined with the release body and moveable between a closed position and an open position, the first jaw defining a bowstring notch;

a trigger joined with at least one of the first jaw and the release body, the trigger moveable between a hold mode and a release mode; and a second magnet joined with the trigger and oriented relative to the first magnet so that a magnetic repelling force is produced between the first magnet and the second magnet, thereby causing the trigger to automatically reset to the hold mode from the release mode, whereby the first jaw resets to the closed position, wherein the first magnet and the second magnet are misaligned with and offset from one another, wherein the first magnet and the second magnet repel one another via the magnetic repelling force.

10. An archery release comprising:

a release body having a longitudinal axis;

a first magnet joined with the release body;

a first jaw joined with the release body and moveable between a closed position and an open position, the first jaw defining a bowstring notch;

a trigger joined with at least one of the first jaw and the release body, the trigger moveable between a hold mode and a release mode; and a second magnet joined with the trigger and oriented relative to the first magnet so that a magnetic repelling force is produced between the first magnet and the second magnet, thereby causing the trigger to automatically reset to the hold mode from the release mode, whereby the first jaw resets to the closed position, wherein the trigger includes a trigger end, wherein the magnetic repelling force exerts a lateral force on the trigger to move the trigger end away from the longitudinal axis as the trigger transitions to the release mode.

11. The archery release of claim 10, wherein the magnetic repelling force exerts a secondary force on the trigger, simultaneous with the lateral force, the secondary force urging the trigger away from the first magnet.

12. An archery release comprising:

a release body having a longitudinal axis;

a first magnet joined with the release body;

a first jaw joined with the release body and moveable between a closed position and an open position, the first jaw defining a bowstring notch;

a trigger joined with at least one of the first jaw and the release body, the trigger moveable between a hold mode and a release mode; and a second magnet joined with the trigger and oriented relative to the first magnet so that a magnetic repelling force is produced between the first magnet and the second magnet, thereby causing the trigger to automatically reset to the hold mode from the release mode, whereby the first jaw resets to the closed position, wherein the first magnet includes a first face having a first center, wherein the second magnet has a second face having a second center, wherein the first center is laterally offset from the second center by at least 0.050 inches, whereby the magnetic repelling force urges the second center away from the longitudinal axis as the trigger initially transitions toward the release mode.

13. An archery release comprising:

a release body having a longitudinal axis;

a first magnet joined with the release body;

a first jaw joined with the release body and moveable between a closed position and an open position, the first jaw defining a bowstring notch;

a trigger joined with at least one of the first jaw and the release body, the trigger moveable between a hold mode and a release mode;

a second magnet joined with the trigger and oriented relative to the first magnet so that a magnetic repelling force is produced between the first magnet and the second magnet, thereby causing the trigger to automatically reset to the hold mode from the release mode, whereby the first jaw resets to the closed position; and a second jaw moveably joined with the release body, on an opposite side of the longitudinal axis of the release body, wherein the second jaw is moveable between a closed position and an open position, wherein the second jaw defines another bowstring notch that cooperates with the bowstring notch of the first jaw to capture a bowstring therein, wherein the magnetic repelling force urges the trigger to engage the second jaw and transition the second jaw from the open position to the closed position when the trigger transitions from the release mode to the hold mode.

14. An archery release comprising:

a release body having a longitudinal axis;

a first magnet joined with the release body;

a first jaw joined with the release body and moveable between a closed position and an open position, the first jaw defining a bowstring notch;

a trigger joined with at least one of the first jaw and the release body, the trigger moveable between a hold mode and a release mode; and a second magnet joined with the trigger and oriented relative to the first magnet so that a magnetic repelling force is produced between the first magnet and the second magnet, thereby causing the trigger to automatically reset to the hold mode from the release mode, whereby the first jaw resets to the closed position, wherein the magnetic repelling force exerts a first magnetic force and a second magnetic force, which is transverse to the first magnetic force, on the trigger so that a portion of the trigger is urged away from the first magnet and outward from a side surface of the release body as the trigger transitions from the hold mode to the release mode.

15. A method of using an archery release, the method comprising:

providing an archery release including a first jaw defining a bowstring notch, the first jaw pivotally joined with a release body and with a trigger via a first pin, the first jaw pivotable about a second pin distal from the first pin;

transitioning the trigger from a hold mode to a release mode; and urging the trigger from the release mode to the hold mode with a magnetic repelling force after the release mode is achieved to automatically reset the archery release to the hold mode without manual input from a user of the archery release.

16. A method of using an archery release, the method comprising:

providing an archery release including a first jaw defining a bowstring notch, the first jaw pivotally joined with a release body;

transitioning a trigger from a hold mode to a release mode; and urging the trigger from the release mode to the hold mode with a magnetic repelling force after the release mode is achieved to automatically reset the archery release to the hold mode without manual input from a user of the archery release, wherein the archery release includes a first magnet and a second magnet that are misaligned with and offset from one another, wherein the first magnet and the second magnet repel one another via the magnetic repelling force.

17. A method of using an archery release, the method comprising:

providing an archery release including a first jaw defining a bowstring notch, the first jaw pivotally joined with a release body;

transitioning a trigger from a hold mode to a release mode; and urging the trigger from the release mode to the hold mode with a magnetic repelling force after the release mode is achieved to automatically reset the archery release to the hold mode without manual input from a user of the archery release, wherein the first magnet exerts a polarity on the second magnet, wherein the second magnet exerts the same polarity on the first magnet, whereby the magnetic repelling force is generated by the first and second magnets.

18. A method of using an archery release, the method comprising:

providing an archery release including a first jaw defining a bowstring notch, the first jaw pivotally joined with a release body;

transitioning a trigger from a hold mode to a release mode; and urging the trigger from the release mode to the hold mode with a magnetic repelling force after the release mode is achieved to automatically reset the archery release to the hold mode without manual input from a user of the archery release, wherein the archery release includes a first magnet and a second magnet, wherein the first magnet includes a first face having a first center, wherein the second magnet has a second face having a second center, wherein the first center is laterally offset from the second center by at least 0.050 inches so that the magnetic repelling force urges the second center away from the longitudinal axis of the release body when the trigger begins to transition to the release mode.

19. An archery release comprising:

a release body;

a first magnet fixedly joined with the release body;

a jaw movably joined with the release body and defining a bowstring notch;

a trigger joined with at least one of the jaw and the release body, the trigger moveable between a hold mode and a release mode; and a second magnet joined and moveable with the trigger, wherein the second magnet and first magnet exert a magnetic repelling force on one another, thereby urging the trigger to automatically reset to the hold mode after the trigger is depressed and released by a user, wherein the first magnet and the second magnet are misaligned with and offset from one another, wherein the first magnet and the second magnet repel one another via the magnetic repelling force.

* * * * *